US005427678A

United States Patent [19]

Yoshimura et al.

[11] Patent Number: 5,427,678

[45] Date of Patent: Jun. 27, 1995

[54] COMPOSITE OXIDE THIN FILM

[75] Inventors: Masahiro Yoshimura, Ayase; Yoo S. Eul, Yokohama; Nobuo Ishizawa, Tokyo, all of Japan

[73] Assignee: Research Development Corporation of Japan, Tokyo, Japan

[21] Appl. No.: 178,619

[22] Filed: Jan. 7, 1994

Related U.S. Application Data

[63] Continuation of Ser. No. 803,737, Dec. 9, 1991, abandoned, which is a continuation of Ser. No. 550,596, Jul. 10, 1990, abandoned.

[30] Foreign Application Priority Data

Jul. 10, 1989 [JP] Japan ..... 1-177491

[51] Int. Cl.[6] ..... C25D 11/02

[52] U.S. Cl. ..... 205/322; 205/326; 205/333

[58] Field of Search ..... 205/322, 326, 333

[56] References Cited

U.S. PATENT DOCUMENTS

| | | | |
|---|---|---|---|
| 3,554,881 | 1/1971 | Piontelli | 205/333 |
| 3,671,410 | 6/1972 | Stahr | 205/322 |
| 3,730,856 | 5/1973 | Hines et al. | 205/322 |
| 3,751,349 | 8/1973 | Nozaki et al. | 205/322 |
| 3,767,541 | 10/1973 | Curtis | 205/322 |
| 4,182,793 | 1/1980 | Nishiyama et al. | 428/701 |
| 4,286,009 | 8/1981 | Griest | 428/701 |
| 4,345,000 | 8/1982 | Kawazoe et al. | 428/697 |
| 4,350,729 | 9/1982 | Nakano et al. | 428/697 |
| 4,382,997 | 5/1983 | Henslee et al. | 428/697 |
| 4,399,194 | 8/1983 | Zelez et al. | 428/697 |
| 4,414,274 | 11/1983 | Hieber | 428/701 |
| 4,501,799 | 2/1985 | Driessen et al. | 428/701 |
| 4,532,174 | 7/1985 | Freller et al. | 428/701 |
| 4,544,602 | 10/1985 | Kobayashi et al. | 428/702 |
| 4,587,041 | 5/1986 | Uedaira et al. | 252/572 |
| 4,619,866 | 10/1986 | Smith et al. | 428/702 |
| 4,716,071 | 12/1987 | Roberts et al. | 428/701 |
| 4,734,340 | 3/1988 | Saito et al. | 428/701 |
| 4,772,520 | 9/1988 | Takeno et al. | 428/701 |
| 4,882,312 | 11/1989 | Mogro-Campero et al. | 428/697 |
| 4,920,014 | 4/1990 | Hirai et al. | 428/700 |
| 4,929,595 | 5/1990 | Wu | 428/701 |
| 4,940,636 | 7/1990 | Brock et al. | 428/701 |

OTHER PUBLICATIONS

Ishizawa et al, *Report of the Research Laboratory of Engineering Materials*, 16, pp. 9–14 (1991).

*Primary Examiner*—Kathryn Gorgos
*Assistant Examiner*—Kishor Mayekar
*Attorney, Agent, or Firm*—Armstrong, Westerman, Hattori, McLeland & Naughton

[57] ABSTRACT

The present invention provides a composite oxide thin film which is characterized in that said thin film is formed, by energizing a work electrode and an opposite electrode immersed in a solution containing reactive components, through the reaction between said reactive components in the solution and said work electrode. More particularly, the present invention provides a composite oxide thin film formed through an electrochemical reaction under water thermal conditions. According to the present invention, improvement of crystallinity is promoted by the use of water thermal conditions as compared with the conventional thin film forming methods, and it is possible to obtain a uniform composite oxide thin film having an excellent crystallinity directly at a relatively low temperature. A large-area thin film can thus easily be manufactured.

9 Claims, 5 Drawing Sheets

COMPOSITE OXIDE THIN FILM

This application is a continuation of application Ser. No. 07/803,737 filed Dec. 9, 1991, now abandoned, which is a continuation of application Ser. No. 07/550,595, filed Jul. 10, 1990 and now abandoned.

BACKGROUND OF THE INVENTION

1. Field of the Invention

The present invention relates to a composite oxide thin film, and more particularly, to a composite oxide thin film formed through an electrochemical reaction and a water thermal reaction.

2. Description of Prior Art

Composite oxide thin films are attracting general attention as electronic materials for various applications and have already been industrialized or subjected to trial manufacture in different manners as materials for an inductor, a sensor, an optical component, a magnetic use and a superconducting application.

There have conventionally been known, as such composite oxide thin films, ones formed by physical evaporation as typically represented by sputtering and ones formed by chemical evaporation as typically represented by CVD and MOCVD. These conventional composite oxide thin films based on vapor synthesis involve some problems to be solved.

More specifically, these films based on vapor synthesis are defective in that they have a low rate of growth of the film and require consumption of much energy. In these methods, easy occurrence of non-uniform evaporation and the reaction under a low partial oxygen pressure tend to cause much oxygen demand, leading to the possibility of being converted into semiconductors, thus needing annealing after film formation. During annealing, however, the substrate and the composite oxide thin film may react, or peeloff may occur.

The low insulation fracture voltage relative to the film thickness is another problem.

In the case of the CVD method, a raw material of a high volatility must be used, but such a raw material is usually unstable and difficult to handle, with a very high cost.

In addition to these vapor phase methods, there are known several thin film forming methods based on the liquid phase process, including, for example, a method for forming a dielectric thin film by causing an electrochemical reaction through immersion or titanium of zirconium in a molten salt of barium or strontium (Japanese Patent Publication No. 43-2,650), a method of immersing titanium in a molten salt (Japanese Patent Publication No. 44-13,455), and a method for forming a $BaTiO_3$ film through a chemical treatment in a strongly alkaline aqueous solution of barium (Japanese Patent Provisional Publication No. 60-116,119).

In the methods using molten salt, however, it is necessary to employ a very high temperature and an expensive pressure vessel and contamination from the vessel is inevitable. It is furthermore difficult to precisely control the film thickness.

In the case of chemical treatments, the defects include the low growth rate and the difficult control of the film thickness, and in addition, there is a concern about contamination from such mineralizers as sodium and potassium. In addition to those mentioned above,- the organic metal application method is known. This method is however defective in that the thermal decomposition through firing of an organic metal compound applied to the substrate at a prescribed temperature causes a considerable shrinkage during the firing step and produces cracks in the resultant composite oxide thin film, and furthermore, evaporation and combustion of the organic components make it difficult to achieve a dense sintar. The reaction with the substrate during firing is another problem.

The present invention was developed in view of the circumstances as described above and has an object to provide a new composite oxide thin film which solves the drawbacks of the conventional thin films, can be synthetically manufactured at a temperature lower than in the conventional manufacturing methods, is uniform and excellent in crystallinity, and easy to manufacture even in the case of a large-area film.

SUMMARY OF THE INVENTION

To solve the above-mentioned problems, the present invention provides a composite oxide thin film which is characterized in that said thin film is formed by energizing a work electrode and an opposite electrode immersed in a solution containing reactive components, through the reaction between said reactive components in the solution and said work electrode.

More particularly, the present invention provides a composite oxide thin film formed through an electrochemical reaction under water thermal conditions.

DETAILED DESCRIPTION OF THE INVENTION

Figure 1:
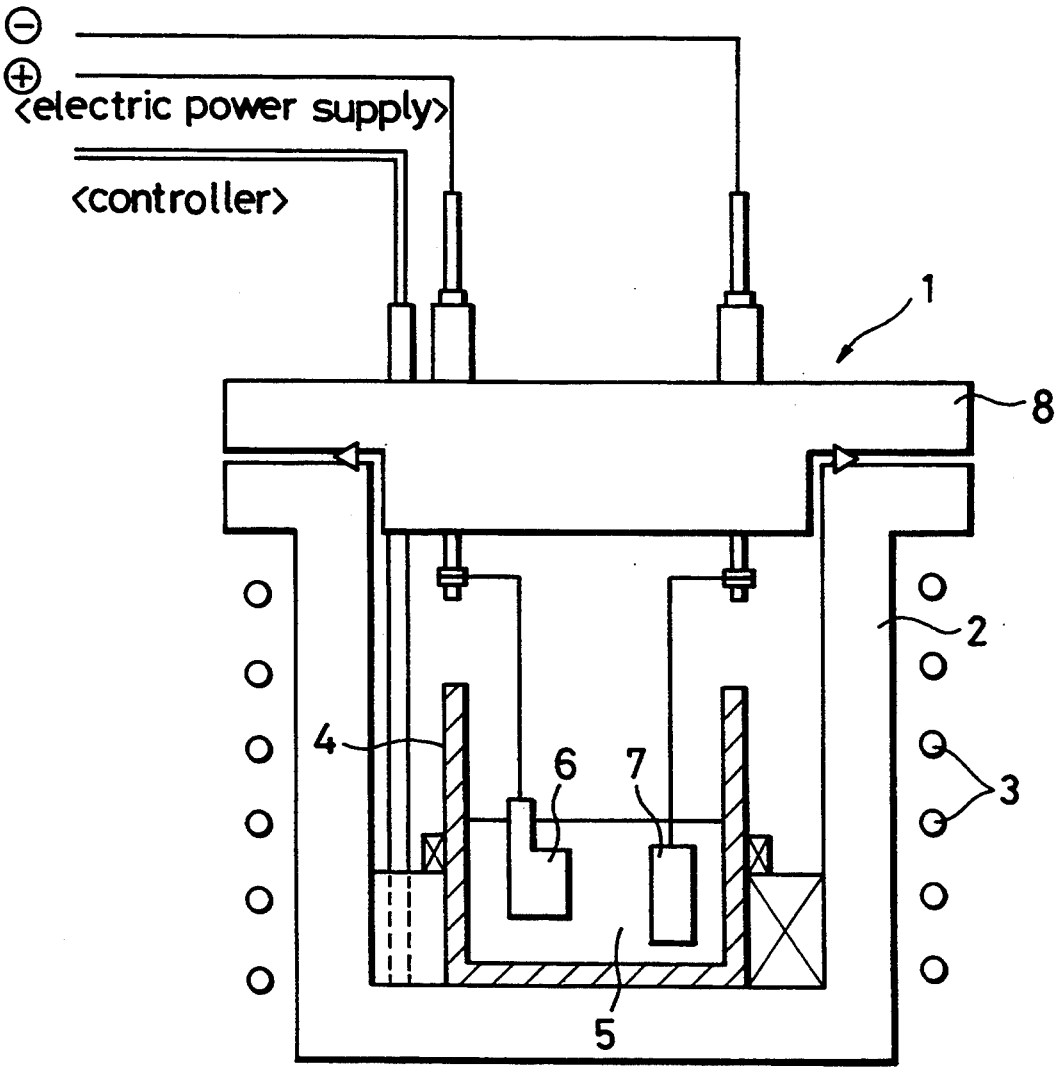
FIG. 1 is a sectional view illustrating an embodiment of the autoclave reaction apparatus suitable for forming the thin film of the present invention.

The work electrode comprises a reaction-active material such as metal, an alloy, an intermetallic compound, or an inorganic substance. In this case, the work electrode may be a single-body electrode or may be a composite or a multi-layer electrode, without any limitation in shape: it may be of a special shape having, for example, a cavity, and the possibility of forming a composite oxide thin film on the outer surface thereof or on the inner surface thereof is one of the features of the present invention. The work electrode may be formed on the substrate comprising of inorganic materials, such as glass, ceramics, and organic polymers.

Any arbitrary opposite electrode may be used.

For the solution containing reactive components, any of various chemical compositions may be adopted.

In general power should preferably be turned on under pressurized and heating conditions in a pressure vessel. The thin film of the present invention may be manufactured, for example, in the apparatus shown in FIG. 1.

In this embodiment, in the apparatus having a heater (3) provided around an outer vessel (2) of an autoclave (1) and an inner vessel (4) such as one made of teflon provided in the interior thereof, a work electrode (6) and an opposite electrode (7) are immersed in a solution (5) containing reactive components. A lid (8) is provided on the top of the outer vessel (2) to close the interior of the outer vessel (2).

In such an apparatus, for example, with a work electrode (6) made of titanium and an opposite electrode (7) made of platinum, serving respectively as the anode and the cathode, $BaTiO_3$ thin film can be formed on the surface of titanium by energizing the electrodes in a barium hydroxide solution. Any metal, alloy or inorganic substance such as aluminum, niobium, zirconium, hafnium, lead, tantalum or iron may be employed in place of titanium. The solution (5) may contain any reactive components reactive with the work electrode (6), including, for example, barium hydroxide, strontium hydroxide, calcium hydroxide, and lithium hydroxide.

When a work electrode (6) made of a metal is used as the anode as described above, the metal of this work electrode (6) forms an oxide or begins to be solved into the solution in the state of anodic oxidation, and reacts with the reactive components in the solution (5), and composite oxides are considered to be formed as a thin film.

The temperature, the pressure and the applied electric current (DC or AC) in the formation of the film, varying with the reaction system, may be appropriately selected. For example, the temperature may be within the range of from 50° C. to the critical point of water (374.2° C.), and the pressure may be at least the saturated vapor pressure. In the case of a lower temperature, an autoclave is not necessary for the reaction.

Now, the present invention is described in more detail by means of examples.

EXAMPLE 1

A thin film was formed with the use of the apparatus shown in FIG. 1, under the following conditions:

Solution:0.5N—$Ba(OH)_2 \cdot 8H_2O$,
Work electrode:Ti (purity: 99.9%),
Opposite electrode:Pt,
Temperature:200° C.,
Pressure:saturated vapor pressure 2.0 MPa,
Electric current:100 mA/cm$^2$ (DC).
$BaTiO_3$ began to form on the surface of the work electrode.

The relationship between the applied voltage and the treatment time is that the voltage shows a sudden initial rise, and immediately after that, a constant value, with no remarkable change thereafter. This is considered attributable to the fact that the growth of the film and dissolution through synthetic reaction of the thin film simultaneously proceed, resulting in equilibrium of speeds.

Figure 2:
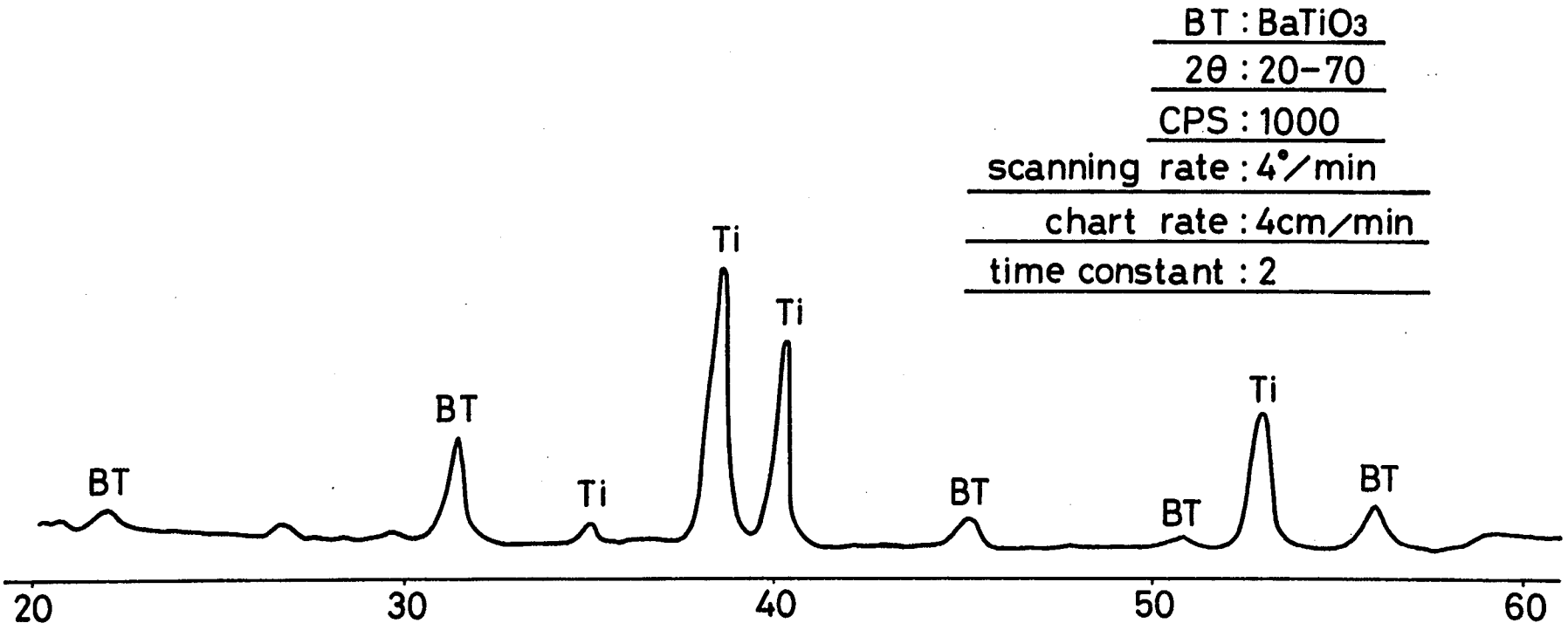
FIGS. 2 and 3 are chart diagrams illustrating the results of X-ray diffraction for an embodiment of the $BaTiO_3$ thin film of the present invention.

The result of X-ray diffraction of the resultant thin film is illustrated in FIG. 2. The formed $BaTiO_3$ was of a single phase and had a satisfactory crystallinity.

EXAMPLE 2

Figure 3:
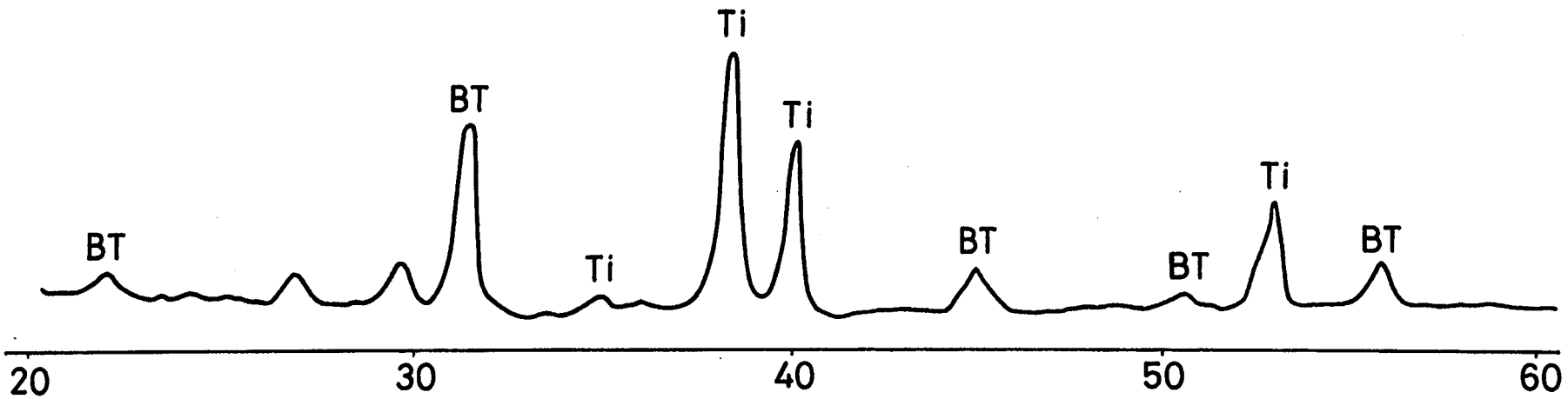

A thin film was formed in the same manner as in the Example 1 with a reaction temperature of 100° C. The result of X-ray diffraction of the resultant $BaTiO_3$ thin film is illustrated in FIG. 3.

EXAMPLE 3 TO 5

Thin films were formed in the same manner as in the Example 1, with a concentration of 0.25N of the solution and a current density of 50 mA/cn$^2$ while changing the temperature from 200° C. to 150° C. and 100° C.

The formation of the $BaTiO_3$ thin film brought about, after the lapse of 30 minutes, the following changes in weight of the work electrode:

200° C.:$4.6\times10^{-6}$ g/(cm$^2$·minute)
150° C.:$4.3\times10^{-6}$ (cm$^2$19 minute)
100° C.:$2.5\times10^{-6}$ (cm$^2$·minute)

EXAMPLE 6

A $BaTiO_3$ thin film was formed on a titanium sheet having a thickness of 1.0 mm by changing only the following conditions:

Solution:0.25N—$Ba(OH)_2 8H_2O$,
Temperature:150° C.,
Electric current:13 mA/cm$^2$,
Time:80 minutes.

A silver electrode was vapor-deposited onto the surface of the resultant $BaTiO_3$ thin film to evaluate dielectric constant characteristics.

It had a capacity of approximately 70 nF, tan $\delta=15\%$ and $\epsilon=300$ (on the assumption of $0\simeq0.1$ $\mu$m).

EXAMPLE 7

A treatment was conducted, with the use of the apparatus as shown in FIG. 1, under the following conditions:

Solution:0.5N—$Ba(OH)_2\sim8H_2O$,
Electrode:both work and opposite electrodes made of metallic titanium,
Temperature:200° C.,
Pressure:saturated vapor pressure 2 MPa,
Voltage:AC, constant voltage of 20 V, 50 Hz.

After the lapse of approximately ten minutes, $BaTiO_3$, formed on the surfaces of the both electrodes. The resultant thin films showed X-ray diffraction patterns similar to that shown in FIG. 2, permitting confirmation of a single phase and an excellent crystallinity.

EXAMPLE 8

A metal Ti was deposited on a surface of pyrex glass substrate in a vapor phase deposition process by a RF sputtering method. The Ti film formed by the above process is used as work electrode. A thin film comprising of composite oxide was formed in the same manner as in the Example 1 and 2.

The formed thin film has a high density and a brighthess. It shows several different color tones, such as blue, violet, gold corresponding to different treatments. A peeling of the thin film was not observed in a treatment of cutting by a shape knife.

EXAMPLE 9

A thin film was formed in the same manner as in the Example 1 and 2, using a Ti deposition film on a surface of polyphenylene sulfide (PPS) film by a process of RF sputtering method. Under the condition of 100°~180° C. temperature, $BaTiO_3$ thin film was formed.

EXAMPLE 10

An $SrTiO_3$ thin film was formed on a titanium sheet having a thickness of 0.2 mm, by changing only the following conditions:

Solution:1N—$Sr(OH)_2 \cdot 8H_2O$,

Temperature:200° C.,
Electric current:50 mA/cm$^2$,
Time:60 minutes.

An $SrTiO_3$ thin film having a satisfactory crystallinity was obtained.

EXAMPLE 11

A mixed solution of 0.5N—$Sr(OH)_2 \cdot 8H_2O$ and 0.5N—$Ba(OH)_2 \cdot 8H_2O$ was employed as the reaction solution, and a thin film was formed under the same conditions as in the Example 8.

Figure 4:
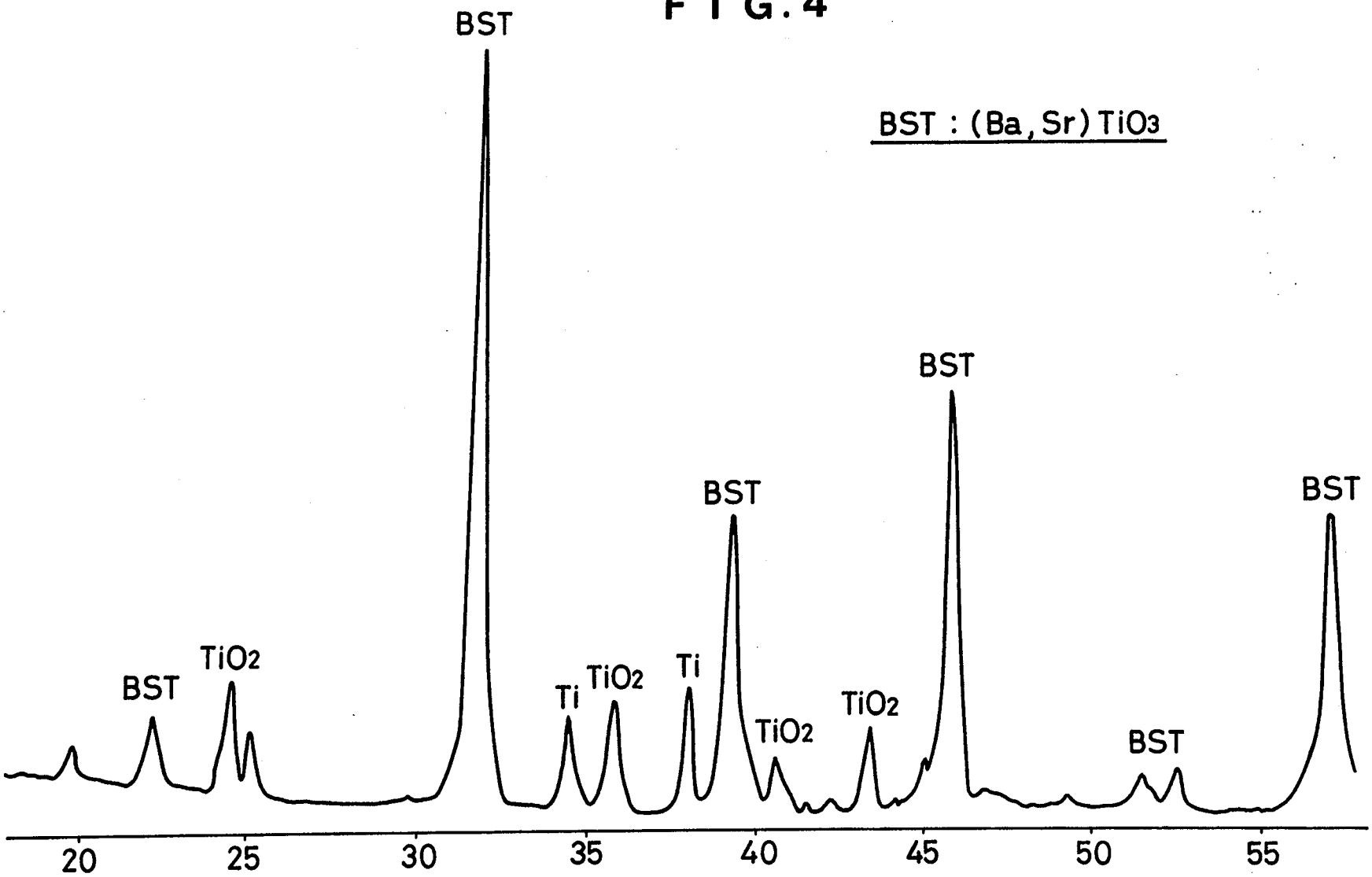
FIG. 4 is a chart diagram illustrating the result of X-ray diffraction for the embodiment of the (Ba, Sr) $TiO_3$ solid-solution thin film of the present invention.

The result of X-ray diffraction of the resultant thin film is illustrated in FIG. 4.

It was confirmed that the thin film thus obtained was a uniform (Ba, Sr)$TiO_3$ solid-solution film in which $BaTiO_3$ and $SrTiO_3$ were not separated,

EXAMPLE 12

An $LiNbO_3$ film was formed under the following conditions:

Reaction solution:1n—LiOH,
Work electrode:Nb (purity: 99.9%),
Temperature:200° C.,
Pressure:1.8 MPa,
Electric current:68 mA/cm$^2$.

After the lapse of approximately 18 minutes, $LiNbO_3$ was formed on the surface of the work electrode.

EXAMPLE 13

A thin film was formed using an iron sheet as the work electrode under the following conditions:

Solution:0.5N—$Ba(OH)_2$—NaOH,
Work electrode:Fe (purity: 99.9%),
Opposite electrode:Pt,
Temperature:200° C.,
Pressure:saturated vapor pressure,
Current density:18 mA/cm$^2$.

Figure 5:
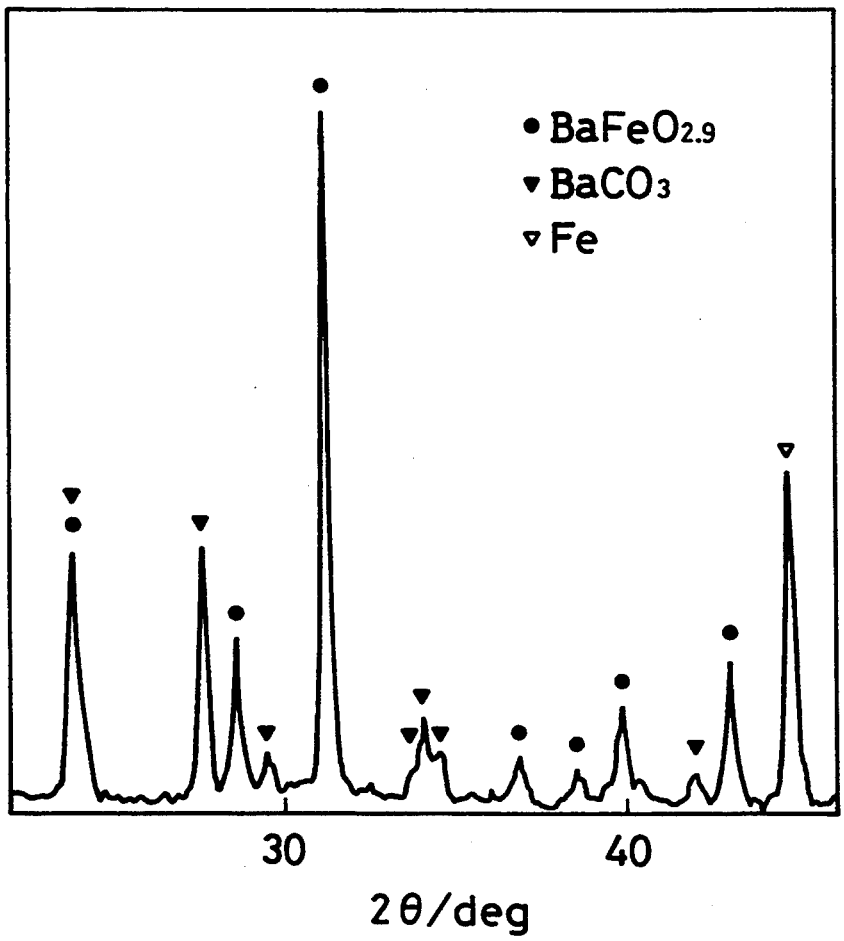
FIG. 5 is a chart diagram illustrating the result of X-ray diffraction for the embodiment of the $BaFeO_{2.9}$ thin film of the present invention.

Formation of a $BaFeO_{2.9}$ film with a satisfactory crystallinity was confirmed from the X-ray diffraction pattern shown in FIG. 5.

No $BaFeO_{2.9}$ was produced when electricity was not turned on.

According to the present invention, as described above in detail, improvement of crystallinity is promoted by the use of water thermal conditions as compared with the conventional thin film forming methods, and it is possible to obtain a uniform composite oxide thin film having an excellent crystallinity directly at a relatively low temperature. A large-area thin film can thus easily be manufactured.

What is claimed is:

1. A method of manufacturing a composite oxide thin film, comprising (i) providing a work electrode and an opposite electrode immersed in an electrolytic solution, said work electrode comprising a first metal, and said electrolytic solution comprising at least one reactive component which is reactive with said work electrode and contains ions of at least one metal other than the first metal in said work electrode;

(ii) energizing said work electrode at a solution temperature of at least 100° C. and under a pressure of at least saturated vapor pressure of the solution, thereby reacting said reactive component with said work electrode and forming a composite oxide thin film which contains oxides of said first metal and said metal other than the first metal.

2. The method of claim 1, wherein said work electrode, said opposite electrode and said solution are contained within a pressure vessel.

3. The method of claim 1, wherein said work electrode comprises a metal selected from the group consisting of titanium, aluminum, niobium, zirconium, hafnium, lead, tantalum and iron.

4. The method of claim 3, wherein said work electrode comprises titanium and said opposite electrode comprises platinum.

5. The method of claim 1, wherein said reactive component is selected from the group consisting of barium hydroxide. strontium hydroxide, calcium hydroxide and lithium hydroxide.

6. The method of claim 5, wherein the pressure vessel further comprises means for heating said interior.

7. The method of claim 6, wherein the temperature of said solution in said pressure vessel is maintained within the range of from 100° C. to 374.2° C.

8. The method of claim 6, wherein direct current is applied to said electrodes in an amount effective to cause reaction of said work electrode and said reactive component.

9. The method of claim 6, wherein alternating current is applied to said electrodes in an amount effective to cause reaction of said work electrode and said reactive component.

* * * * *